US007776168B2

(12) United States Patent
Meyer et al.

(10) Patent No.: US 7,776,168 B2
(45) Date of Patent: Aug. 17, 2010

(54) METHOD FOR THE THERMAL TREATMENT OF FOUNDRY PIECES MADE FROM AN ALLOY BASED ON ALUMINIUM AND FOUNDRY PIECES WITH IMPROVED MECHANICAL PROPERTIES

(75) Inventors: Philippe Meyer, Ronquerolles (FR); Denis Massinon, Liancourt (FR); Virginie Jacquet, Paris (FR)

(73) Assignee: Montupet S.A. (FR)

( * ) Notice: Subject to any disclaimer, the term of this patent is extended or adjusted under 35 U.S.C. 154(b) by 0 days.

(21) Appl. No.: 10/508,227

(22) PCT Filed: Mar. 20, 2003

(86) PCT No.: PCT/FR03/00887

§ 371 (c)(1),
(2), (4) Date: Apr. 18, 2005

(87) PCT Pub. No.: WO03/078674

PCT Pub. Date: Sep. 25, 2003

(65) Prior Publication Data

US 2005/0217771 A1 Oct. 6, 2005

(30) Foreign Application Priority Data

Mar. 20, 2002 (FR) ..... 02 03530

(51) Int. Cl.
*C22F 1/05* (2006.01)

(52) U.S. Cl. ..... 148/700; 148/698

(58) Field of Classification Search ..... 148/698, 148/702, 690, 693, 694, 697
See application file for complete search history.

(56) References Cited

U.S. PATENT DOCUMENTS 4,066,476 A * 1/1978 Gullotti et al. ..... 148/692
6,074,501 A * 6/2000 Baxter et al. ..... 148/700

FOREIGN PATENT DOCUMENTS

EP 1 065 292 B1 6/2004
WO WO-01/16387 A1 3/2001

OTHER PUBLICATIONS

"Aluminum and Aluminum Alloys", ASM International, 1993, p. 34-38, 44.*
'ASM Handbook: vol. 4 Heat treating', ASM International, 1991, pp. 851-853.*

* cited by examiner

*Primary Examiner*—Roy King
*Assistant Examiner*—Janelle Morillo
(74) *Attorney, Agent, or Firm*—Lerner, David, Littenberg, Krumholz & Mentlik, LLP

(57) ABSTRACT

A method of heat-treating a casting made of an aluminum-based alloy including an alloy of aluminum, silicon, and magnesium comprising heat treating the casting at a first temperature range for a first duration; gradually cooling the casting to a second temperature having a second temperature range; maintaining the casting at the second temperature range for a second duration; quenching the casting; and age hardening the casting.

19 Claims, 3 Drawing Sheets

METHOD FOR THE THERMAL TREATMENT OF FOUNDRY PIECES MADE FROM AN ALLOY BASED ON ALUMINIUM AND FOUNDRY PIECES WITH IMPROVED MECHANICAL PROPERTIES

CROSS REFERENCE TO RELATED APPLICATIONS

The present application is the National Stage of International Application No. PCT/FR03/00887, filed on Mar. 20, 2003, which claims the benefit of French Application No. 02/03530, filed on Mar. 20, 2002.

BACKGROUND OF THE INVENTION

The present invention relates in general to heat treating casting alloys based on aluminum and containing silicon, and also to the resulting castings.

Aluminum-based casting alloys comprise various composition families, most of which are suitable for structural hardening by heat treatment. In particular, mention can be made of the aluminum/silicon/magnesium family typically represented by AlSi7% Mg0.3%, AlSi7Mg0.6%, and AlSi10% Mg0.3% type alloys, and the aluminum/silicon/copper/magnesium family typically represented by AlSi(5% to 10%)Cu (2% to 3.5%)Mg(0.2% to 0.3%) type alloys.

All those alloys are widely used for the mass production of automobile components, for example cylinder heads that are subjected to very high stress while in use. In order to maximize the mechanical properties of such alloys, at least in cases of the most severe stresses, it is usual to carry out heat treatment consisting of solution heat treatment and quenching, followed by age hardening for structural hardening.

One drawback of that kind of treatment is that it can make the alloy very difficult to machine, particularly with structurally hardened alloys including little or no copper (typically, at contents of not more than 1%).

In particular, the machining of very fine threads (for example, threads for fastening injectors to diesel engine cylinder heads), long, small-diameter drilling and the deburring of machined surfaces can present problems (for example, burrs that cannot be broken up are difficult to eliminate by brushing).

Document EP-A-1 065 292 describes a method of cooling a workpiece made of light alloy following solution heat treatment of the workpiece, which can be thought of as staged quenching, by immersing the workpiece in a bath of salt so as to bring its temperature rapidly to a value lying in the range 350° C. to 450° C. Such a known method has the effect of increasing the high-temperature tensile strength of the material of the workpiece, but does not in any way resolve the problems relating to machinability. Moreover, that method results in weaker characteristics at room temperature, which are unacceptable for applications of the combustion engine cylinder head type.

Thus, to date, there is no technique for facilitating the machining of parts made of an alloy of the type with structural hardening or the like.

SUMMARY OF THE INVENTION

The present invention aims at mitigating those drawbacks and at making it possible to obtain castings offering a good compromise between the intrinsic performance which is demanded of them, particularly in terms of their ability to withstand various kinds of stress, of their machinability, and of their suitability for deburring after machining.

To this end, in a first aspect, the invention provides a method of heat-treating a casting made of an aluminum-based alloy, particularly an alloy of aluminum, silicon, and magnesium, and optionally copper, the method being characterized in that it comprises the following steps:

- solution heat treating the casting at a first temperature range for a first duration;
- gradually cooling the casting to a second temperature lying within a second temperature range lower than the first range;
- continuing solution heat treatment of the part by maintaining it at the second temperature range for a second duration;
- quenching the part; and
- age hardening the part.

A number of preferred, but non-limiting, aspects of the method are as follows:

- the second temperature range is selected in such a manner that the treated alloy has its tensile strength reduced by an amount in the range about 10% to about 40%, and preferably in the range about 15% to about 35%, relative to the tensile strength which would be obtained with a single solution heat treatment at the first temperature range and for a duration equal to the sum of the first and second durations;
- the second temperature range is lower than the first temperature range by about 8% to about 14%;
- for an alloy having a low copper content (typically 1% by weight, or less), the first temperature range is about 510° C. to about 550° C., and preferably about 520° C. to about 540° C.;
- the first duration then lies in the range about 1 hour (h) to about 4 h, and preferably in the range about 1 h to about 2 h;
- the second temperature range is then about 455° C. to about 485° C., and preferably is about 460° C. to about 480° C.;
- the second duration then lies in the range about 1 h to about 5 h, and preferably in the range about 1 h to about 3 h; and
- the duration of step (b) then lies in the range about 30 minutes (min) to about 3 h and 30 min, and preferably in the range about 1 h to about 2 h and 30 min.

In a second aspect, the present invention also provides a casting made of an aluminum-based alloy, particularly, in an alloy of aluminum, silicon, and magnesium, and optionally copper, with, in particular, a copper content of less than about 1% by weight, and presenting improved machinability, the casting being characterized in that it presents:

- a tensile strength lying in the range 220 mega pascals (MPa) to 300 MPa;
- a 0.2% elastic limit lying in the range 170 MPa to 270 MPa;
- a Brinell hardness number lying in the range 75 to 110.

BRIEF DESCRIPTION OF THE DRAWINGS

Other aspects, aims, and advantages of the present invention will become more apparent on reading the detailed description of a preferred implementation thereof, given by way of a non-limiting example and with reference to the accompanying drawings, in which.

DETAILED DESCRIPTION

Figure 1:
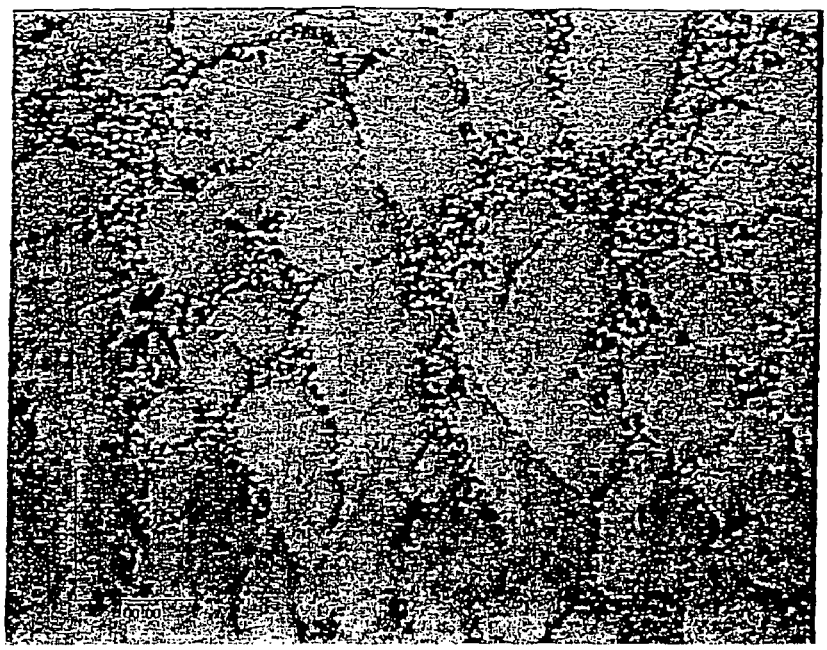
FIG. 1 shows the microstructure of a first type of alloy treated in accordance with prior art.

The invention is described in detail below.

Heat treatment based on the invention is carried out by putting into solution at two temperature plateaus. The first plateau is implemented in a high temperature range, i.e. in the temperature range which is usual for solution heat treatment of the alloys in question, that the person skilled in the art will define using well-known points of reference. Typically, for alloys containing less than 1% copper by weight, the first temperature lies in the range about 510° C. to about 550° C., preferably in the range about 520° C. to about 540° C., and more particularly around 530° C. For alloys with a higher copper content, the temperature will be lower, for example in the range about 475° C. to about 515° C., and, for alloys with a copper content of 2% to 3% by weight, preferably around 495° C. Mainly for economic reasons, the first plateau is limited to durations in the order of 1 h to 4 h, and preferably 1 h to 2 h, in the knowledge that extending this plateau does not lead to any significant improvement in the final properties of the material.

The first plateau is followed by a second plateau in a second temperature range that is lower. Still for an alloy containing not more than 1% copper by weight, the temperature range is about 455° C. to about 485° C., preferably about 460° C. to about 480° C., and more preferably around 465° C. (it is specified that for an alloy with a copper content of 2% to 3% by weight, the second temperature range is advantageously 425° C. to 455° C., and more preferably around 450° C.).

More generally, the second temperature range is lower than the first temperature range by about 8% to about 14%.

The duration of the second step is in the order of 1 h to 5 h, preferably 1 h to 3 h. Indeed, it appears that extending the retention time at the second plateau does not lead to any significant changes in final properties, thus, once again, in economic terms, it is worth reducing the retention time.

Between the two solution heat treatment plateaus, cooling is effected in such a manner as to move gradually from the highest temperature to the lowest temperature in a duration lying in the range 30 min to 3 h 30 min. Preferably, again mainly for economic reasons, the duration lies in the range 1 h to 2 h 30 min.

After the second, lower-temperature solution heat treatment plateau, quenching is applied under the usual conditions, such as quenching in water.

Lastly, age hardening is performed in order to develop hardening precipitation of the alloy. This age hardening operation is selected from amongst the usual temperature ranges and durations; depending on the properties desired, there may be under-age hardening, age hardening to peak tensile strength, or over-age hardening.

The temperature of the second solution heat treatment plateau, when chosen as determined above, makes it possible for the tensile strength properties of the alloy thus treated to be reduced by an amount lying in the range about 10% to about 40%, and preferably in the range about 15% to about 35%, in comparison with the properties which would be obtained with a single solution heat treatment at the first temperature and for a duration equal to the sum of the durations at the two plateaus (including the cooling stage between the first plateau and the second plateau), and maintaining the same quenching and age hardening conditions.

In practice, compared with conventional single-plateau heat treatment, the invention seeks a better compromise between the tensile strength, elongation, and quality index properties. More particularly, it has been observed that it is preferable to reduce properties by an amount in the range 15% to 35% in order to optimize the strength/elongation combination, whilst benefiting from improved machinability.

Moreover, it has also been found that two-plateau solution heat treatment reduces very significantly the residual stresses present in the workpiece after the heat treatment has been completed. This may be of significant advantage to the strength of parts that are subjected to major stress, particularly combustion engine cylinder heads.

The following examples will show how the invention works:

Comparison Between the Invention and the Prior Art in Terms of Impact on Microstructure and on the Strength/Elongation Compromise A cylinder head made of second melt AlSi7% Mg0.4% alloy, cast at low pressure, weighing about 18 kilograms (kg), and subjected to prior art heat treatment (solution heat treatment at the maximum temperature, quenching, and age hardening) presents difficulties for machining: large-sized pieces of drilling swarf tend to wind themselves around the cutting tools (or else remain in the oil circuits, for example). It is difficult, therefore, to remove them. Such machining problems are connected with the alloy characteristics that are obtained after the known heat treatment.

More precisely, after traditional solution heat treatment at 530° C. for 5 h, followed by quenching in water at 90° C., and by age hardening at 200° C. for 5 h, the mechanical characteristics obtained on the cylinder head on its rocker-arm face were as follows:

| | |
|---|---|
| Breaking strength | 341 MPa |
| Elastic limit at 0.2% deformation | 298 MPa |
| Plastic elongation | 2.17% |
| Brinell hardness number | 112 |
| Quality index | 391 MPa |

Typical microstructure after the usual heat treatment reveals:

silicon spheroidized by remaining at a high temperature, as shown in FIG. 1 of the drawings; and optimum putting into solution, i.e. no $Mg_2Si$ component was observed that was not in the solution.

Instead of the known heat treatment, a heat treatment was performed on an identical cylinder head at a first temperature plateau of 530° C., for 2 h, then at a second plateau of 465° C., for 2 h, leaving a 1 h period for the temperature to go from the first temperature to the second, then quenching in water at 90° C., and age hardening at 200° C. for 5 h.

The mechanical characteristics of the material were then as follows:

| | | |
|---|---|---|
| Breaking strength | 231 MPa | (−32%) |
| Elastic limit at 0.2% deformation | 207 MPa | (−30%) |
| Plastic elongation | 4.64% | (+114%) |
| Brinell hardness number | 90 | (−20%) |
| Quality index | 331 MPa | (−15%) |

With the treatment of the invention, breaking strength, elastic limit, and hardness were decreased by an amount in the range 20% to 32%. The decrease is to the benefit of a very considerable increase in the plastic elongation (i.e. breaking elongation +114%).

Figure 2:
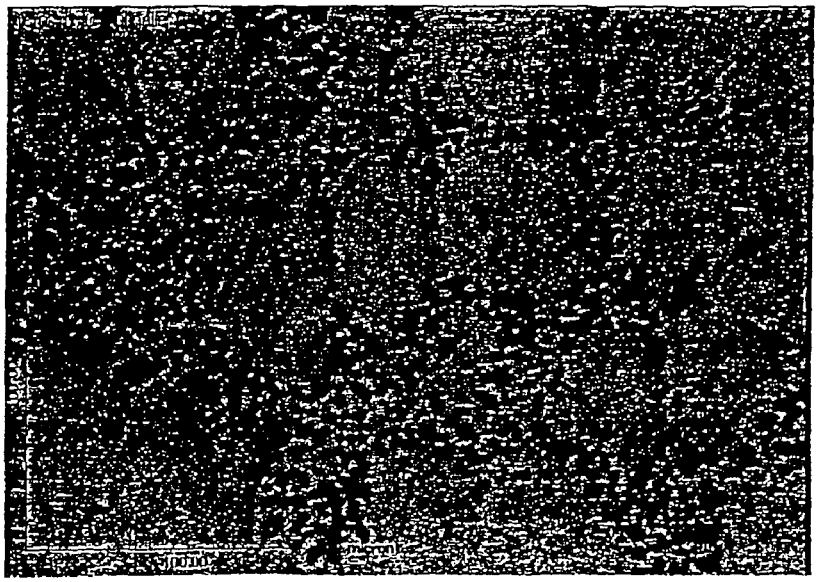
FIG. 2 shows the microstructure of this same type of alloy treated in accordance with the present invention.

In terms of microstructure, the heat treatment of the present invention reveals the presence of silicon spheroidized by the high temperature solution heat treatment, as shown in FIG. 2 of the drawings, whilst reducing the strength or hardness in comparison with conventional solution heat treatment.

2) Impact of the Temperature at the Second Plateau

In order to find an optimum temperature at the second plateau, solution heat treatment was carried out using two plateaus, with a second temperature lower than in the above example, i.e. at 450° C. and at 400° C., respectively. In both cases, solution heat treatment at 530° C. was carried out for 2 h, and then solution heat treatment was carried out for 3 h at 450° C. or at 400° C., with a duration of 90 min or 120 min to reach the second temperature.

Again, solution heat treatment was followed by quenching in water at 90° C. and age hardening for 5 h at 200° C.

But such second plateaus at lower temperatures were found to have caused too great a drop in the mechanical characteristics, as shown in the table below:

Treatment in Two stages:

| 530° C. | then, 450° C. | or 400° C. |
|---|---|---|
| Breaking strength (MPa) | 207 (−39%) | 169 (−50%) |
| Elastic limit at 0.2% deformation (MPa) | 151 (−49%) | 8.41 (+288%) |
| Plastic elongation (%) | 4.22 (+94%) | 8.41 (+288%) |
| Brinell hardness number | 70 (−37%) | 61 (−45%) |

3) Impact of the First Step at High Temperature on Microstructure

Figure 3:
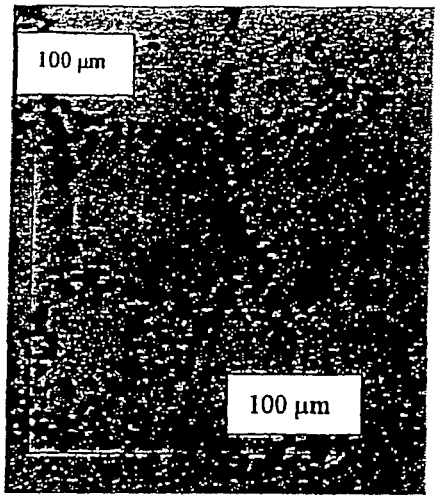
FIG. 3 shows the microstructure of a second type of alloy treated in accordance with the present invention.
Figure 4:
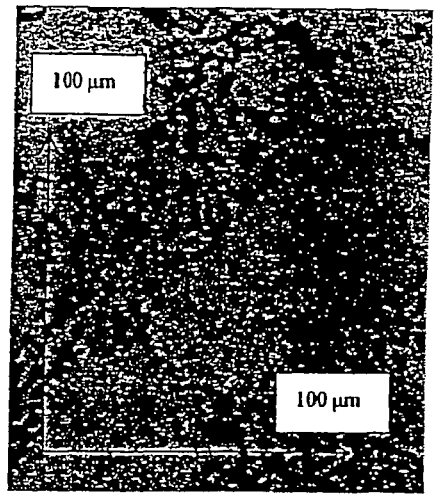
FIG. 4 shows the microstructure of the same type of alloy treated differently from the present invention.

Using a casting made of an alloy of the above-mentioned type, but modified with strontium, a two-plateau solution heat treatment of the invention was carried out, and also a single-plateau solution heat treatment at a temperature of 465° C. In the two-plateau case, the high temperature plateau caused spheroidization of the silicon, as shown in FIG. 3, whereas in the single-plateau phase, spheroidization did not occur, as shown in FIG. 4.

4) Impact of Two Plateaus on Mechanical Characteristics

The mechanical characteristics are also affected by the type of solution heat treatment used, being improved by two-plateau solution heat treatment.

Figure 5:
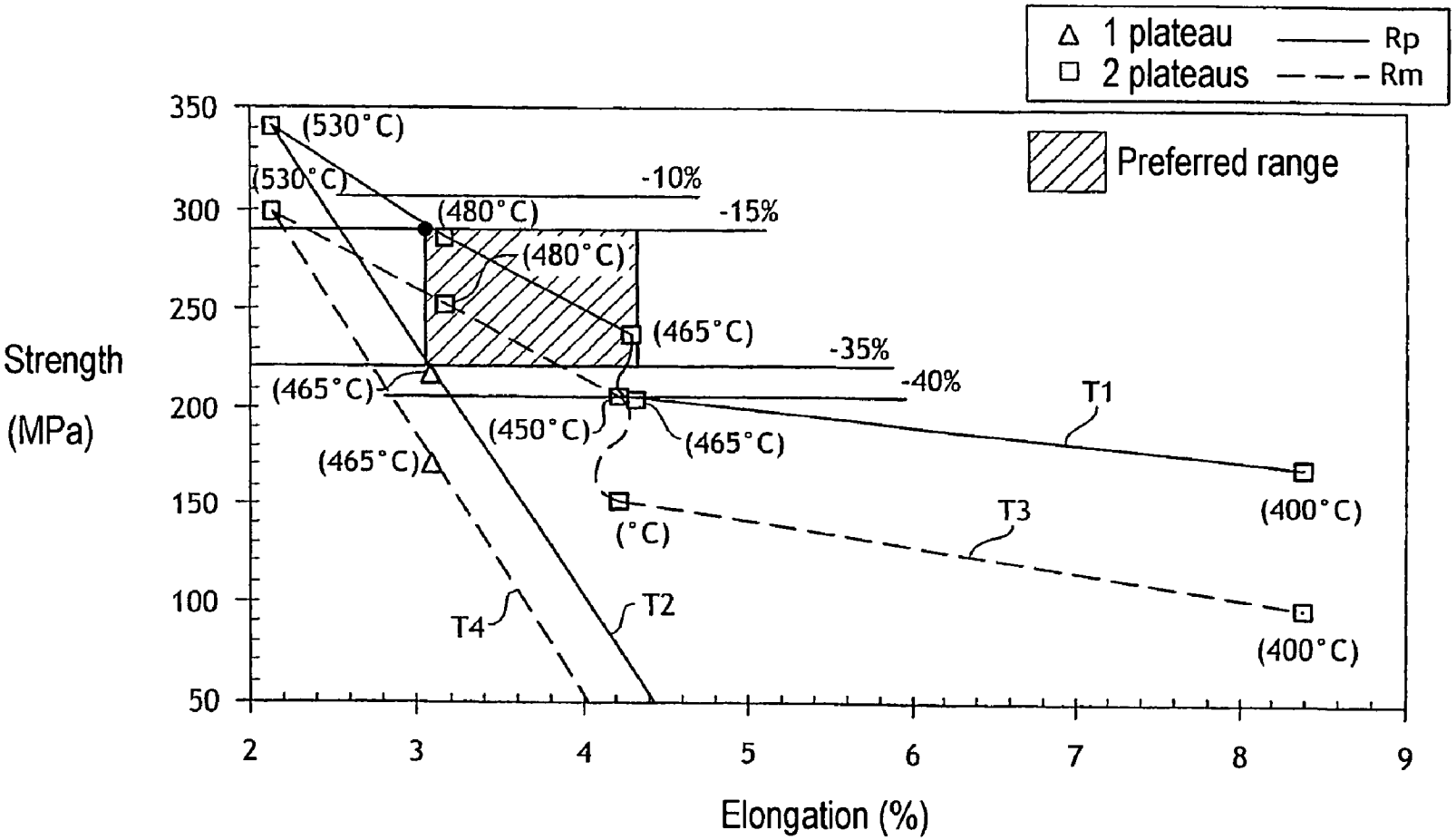
FIG. 5 is a diagram of strength/elongation mechanical properties, showing the properties which can be obtained with the invention.

The diagram shown in FIG. 5 of the drawings shows the compromise between the mechanical strengths (breaking strength Rm and elastic limit at 0.2% deformation Rp, in MPa) and breaking elongation (in %) after single-plateau and two-plateau heat treatment, based on the temperature at the single plateau and on the temperature at the second plateau. The squares (invention) and the triangles (single-plateau heat treatment) correspond to different temperatures, as shown in the diagram.

In FIG. 5, the continuous line T1 shows the variation in the breaking strength/elongation pair as a function of the second temperature of two-plateau solution heat treatment, whilst the dashed line T2 shows the variation of the same characteristics as a function of the temperature of a single-plateau solution heat treatment. The dashed line T3 shows the variation of the elastic limit/elongation pair as a function of the second temperature in two-plateau solution heat treatment, whereas the dashed line T4 shows the variation of the same characteristics as a function of the temperature in single-plateau solution heat treatment.

In FIG. 5, and in association with the curves T1 and T3 obtained using the invention, there are shown the 10% and 40% decreases in strength corresponding to one range of the invention, and also the 15% and 35% decreases corresponding to a particularly preferred range of the invention (hatching).

Moreover, by means of the positions of the curves T1 and T3 relative to the curves T2 and T4, respectively, FIG. 5 shows that two-plateau solution heat treatment offers a strength/breaking elongation compromise that is better than for the same material subjected to single-plateau heat treatment, and this applies whatever the temperature of the single plateau.

5) Machinability Tests

In order to study the impact of the invention on machinability, two tests were carried out, one on a reference cylinder head made in accordance with the prior art (single-plateau heat treatment at 530° C. for 5 h), as described in point 1) above, with the same alloy, and the other on a cylinder head made out of the same alloy and subjected to heat treatment at two temperature plateaus in accordance with the invention, that is, at 530° C. for 2 h and at 465° C. for 2 h, with intermediate cooling for 1 h.

In both cases, solution heat treatment was followed by quenching in water at 90° C. and then by age hardening at 190° C. for 5 h.

It was also found that the cylinder heads treated in accordance with the invention were easier to machine. As an indication, easier machinability was characterized by the fact that the average length of the pieces of swarf was reduced and their average density was increased, leading to improved fragmentability by the pieces of swarf, as shown in the table below:

| | Average length of the pieces of swarf | Average density |
|---|---|---|
| Reference | 2.6 cm | 0.11 g/cm$^3$ |
| According to the invention | 2 populations: 0.7 cm* and 2.2 cm | (measured on an unsorted population) 0.64 g/cm$^3$ |

*majority population

Of course, the present invention is not limited in any way to the embodiments shown and described above, and the person skilled in the art will know how to effect numerous variations and modifications thereto.

In particular, the person skilled in the art will know how to vary the exact profile of temperature variation during the solution heat treatment, particularly with more than two plateaus, or even with plateaus within which the temperature can vary over a certain range.

Moreover, the person skilled in the art will know how to adapt the various parameters as a function mainly, but not exclusively, of:

the type of alloy used;

the weight and/or volume of the workpiece;

the intended application;

the type of machining to be carried out, etc.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of heat-treating a casting made of an aluminum-based age-hardenable alloy comprising aluminum, silicon, and magnesium comprising the steps of:

(a) solution heat treating the casting within a first temperature range for a first duration;

(b) gradually cooling the casting to within a second temperature range;

(c) continuing solution heat treatment by maintaining the casting within the second temperature range for a duration from 1 hour to 5 hours;

(d) quenching the casting; and (e) artificial age hardening the casting wherein said age hardened cast alloy has a tensile strength which is reduced by an amount ranging from 10% to 40% relative to a tensile strength obtained with a single solution heat treatment.

2. The method according to claim 1, wherein the amount is 15% to 35%.

3. The method according to claim 1, wherein the second temperature range is lower than the first temperature range in an amount ranging from 8% to 14%.

4. The method according to claim 1, wherein the first temperature range is from 510° C. to 550° C.

5. The method according to claim 4, wherein the first temperature range is from 520° C. to 540° C.

6. The method according to claim 1, wherein the first duration is from 1 hour to 4 hours.

7. The method according to claim 6, wherein the first duration is from 1 hour to 2 hours.

8. The method according to claim 1, wherein the second temperature range is from 455° C. to 485° C.

9. The method according to claim 8, wherein the second temperature range is from 460° C. to 480° C.

10. The method according to claim 1, wherein a second duration is from 1 hour to 3 hours.

11. The method according to claim 1, wherein the duration of step (b) is greater than or equal to 30 minutes.

12. The method according to claim 1, wherein the duration of step (b) is from 1 hour to two hours and thirty minutes

13. A method of heat-treating a casting made of an aluminum-based age-hardenable alloy comprising aluminum, silicon, and magnesium comprising the steps of:

(a) solution heat treating the casting within a first temperature range for a first duration;

(b) gradually cooling the casting to within a second temperature range over a duration which is greater than or equal to 30 minutes;

(c) continuing solution heat treatment by maintaining the casting within the second temperature range for a second duration;

(d) quenching the casting; and (e) artificial age hardening the casting wherein said age hardened cast alloy has a tensile strength which is reduced by an amount ranging from 10% to 40% relative to a tensile strength obtained with a single solution heat treatment.

14. The method according to claim 13, wherein the first temperature range is from 510° C. to 550° C.

15. The method according to claim 13, wherein the first duration is from 1 hour to 4 hours.

16. The method according to claim 13, wherein the second temperature range is from 455° C. to 485° C.

17. The method according to claim 13, wherein the second duration is from 1 hour to 5 hours.

18. The method of claim 13, wherein the duration of step (b) is from 1 hour to 2 hours and 30 minutes.

19. A method of heat-treating a casting made of an aluminum-based age-hardenable alloy comprising aluminum, silicon, and magnesium comprising the steps of:

(a) solution heat treating the casting within a first temperature range for a first duration;

(b) gradually cooling the casting to within a second temperature range over a duration which is greater than or equal to 30 minutes;

(c) continuing solution heat treatment by maintaining the casting within the second temperature range for a duration from 1 hour to 5 hours;

(d) quenching the casting; and (e) artificial age hardening the casting wherein said age hardened cast alloy has a tensile strength which is reduced by an amount ranging from 10% to 40% relative to a tensile strength obtained with a single solution heat treatment.

* * * * *